US010531749B1

(12) United States Patent
Houdashell et al.

(10) Patent No.: US 10,531,749 B1
(45) Date of Patent: Jan. 14, 2020

(54) ORNAMENT DECORATOR HOLDER AND METHOD OF USE

(71) Applicants: Gale Scott Houdashell, Amarillo, TX (US); Charles Curtis McGill, Amarillo, TX (US)

(72) Inventors: Gale Scott Houdashell, Amarillo, TX (US); Charles Curtis McGill, Amarillo, TX (US)

( * ) Notice: Subject to any disclaimer, the term of this patent is extended or adjusted under 35 U.S.C. 154(b) by 0 days.

(21) Appl. No.: 15/900,402

(22) Filed: Feb. 20, 2018

Related U.S. Application Data

(60) Provisional application No. 62/460,973, filed on Feb. 20, 2017.

(51) Int. Cl.
*A47F 3/00* (2006.01)
*A47F 5/025* (2006.01)

(52) U.S. Cl.
CPC ..... *A47F 5/025* (2013.01); *A47F 3/00* (2013.01)

(58) Field of Classification Search
CPC ..... A47F 5/025; A47F 5/02; A47F 3/00
USPC ..... 312/114
See application file for complete search history.

(56) References Cited

U.S. PATENT DOCUMENTS 1,760,344 A * 5/1930 Charavay ..... B05B 16/60 454/50
3,006,111 A * 10/1961 Koch ..... A63H 5/00 40/426
3,847,116 A * 11/1974 Prichard ..... D06B 11/0059 118/52
4,173,667 A * 11/1979 Rusch ..... A47G 33/08 206/575
4,285,746 A * 8/1981 DePuy ..... A47G 33/08 156/265
4,852,283 A * 8/1989 Teng ..... A63H 13/04 40/410
5,134,778 A * 8/1992 MacCarthy ..... B43L 11/06 33/27.11
5,286,535 A * 2/1994 Hou ..... G09F 19/02 40/455
5,696,333 A * 12/1997 Shih ..... A45C 11/16 206/6.1
5,918,393 A * 7/1999 Martell ..... A47F 3/001 206/315.9
6,053,322 A * 4/2000 Kim ..... B44D 2/002 206/1.7
6,357,151 B1 * 3/2002 Yuen ..... G09F 19/02 40/406
6,467,623 B1 * 10/2002 Lewis ..... A47F 5/025 206/388
6,568,107 B2 * 5/2003 Yuen ..... G09F 19/02 40/406

(Continued)

*Primary Examiner* — Daniel J Troy
*Assistant Examiner* — Timothy M Ayres
(74) *Attorney, Agent, or Firm* — Eldredge Law Firm

(57) ABSTRACT

A device to hold an ornament includes a body with a plurality of walls forming an inner cavity to receive the ornament, the body has an opening into the inner cavity; and a base; a motor disposed within the base and the motor having an activation switch accessible from an outside wall of the body; a power source connected to the motor; and an ornament attachment site accessible from the inner cavity to attach the ornament to the motor; the motor rotates the ornament within the inner cavity; the ornament is accessible from the opening of the body.

6 Claims, 5 Drawing Sheets

(56) References Cited

U.S. PATENT DOCUMENTS

2008/0067086 A1* 3/2008 Uidl ..... A47F 3/10
206/232
2008/0110066 A1* 5/2008 Peroni ..... G09F 19/02
40/430
2010/0187736 A1* 7/2010 Hutson ..... B25B 11/002
269/8

* cited by examiner

ORNAMENT DECORATOR HOLDER AND METHOD OF USE

BACKGROUND

1. Field of the Invention

The present invention relates generally to devices for holding objects, and more specifically, to an ornament holder for aiding in ornament decoration.

2. Description of Related Art

Ornament holding devices are well known in the art and are effective means to display ornaments. For example, FIG. 1 depicts a conventional ornament holding device 101 having a base 103 with a holder 105 extending upward and having a hook 107. During use, an ornament 109 is hung from hook 107.

One of the problems commonly associated with system 101 is instability. For example, a common activity involves decorating ornament 109 with markers or the like. Holding device 101 allows for ornament 109 to swing and move unpredictably when pressure is applied by a marker, therefore decorating can be challenging and frustrating.

Accordingly, although great strides have been made in the area of ornament holding devices, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
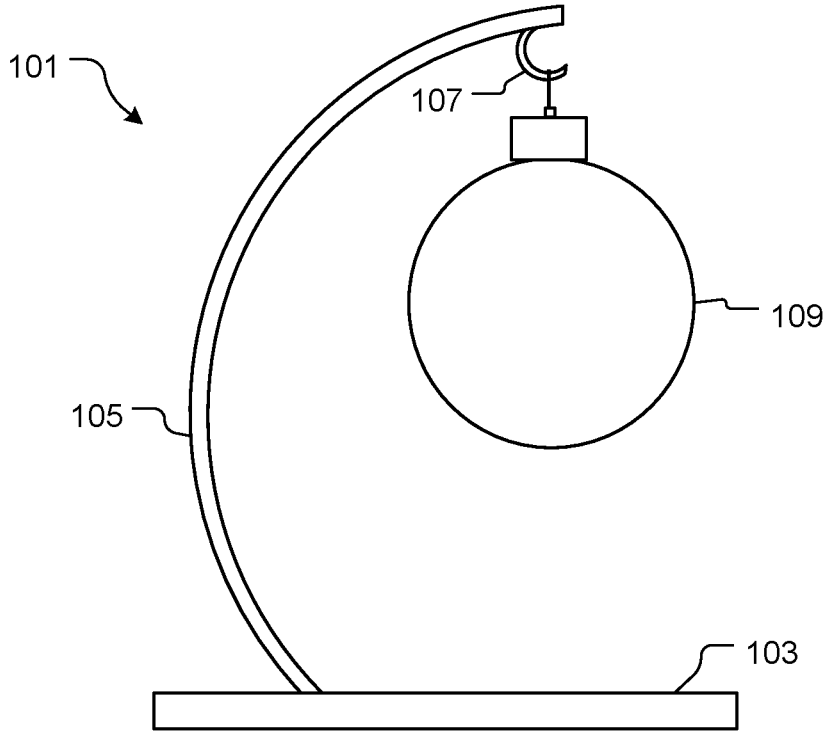
FIG. 1 (Prior Art)
FIG. 1 is a side view of a common ornament holding device.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional holding devices. Specifically, the present invention provides a means to hold an ornament while preventing unwanted swaying or movement. In addition, the present invention provides a means to rotate an ornament for improved decoration. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
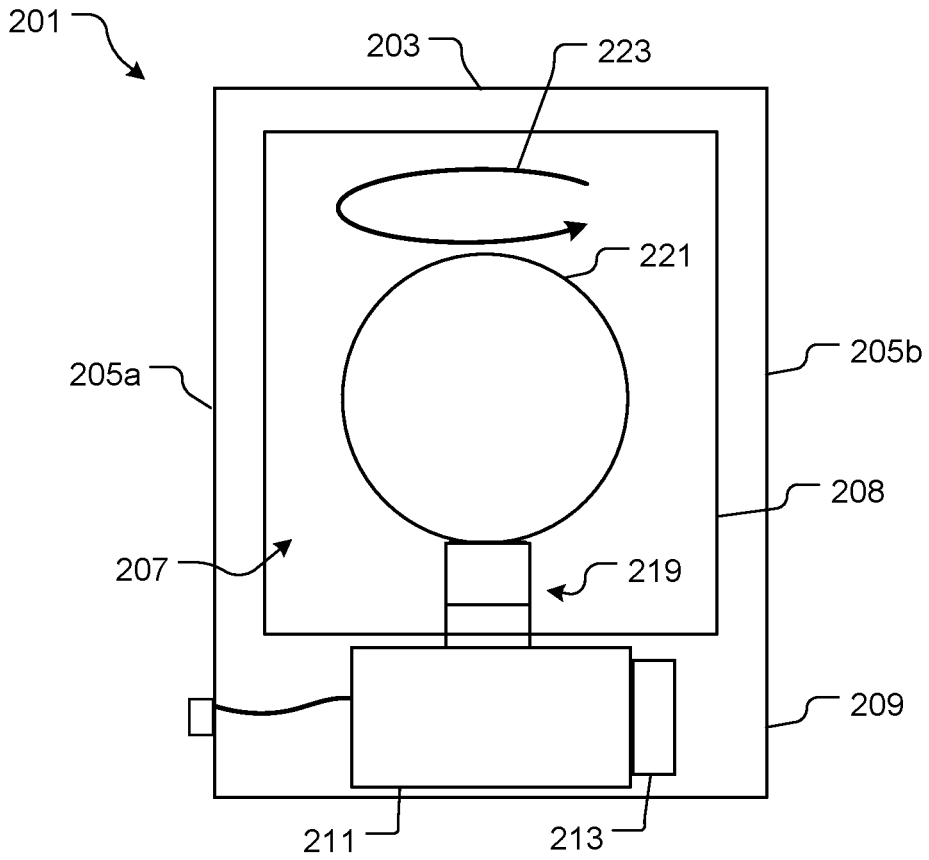
FIG. 2 is a front view of an ornament holding device in accordance with a preferred embodiment of the present application.

Referring now to the drawings wherein like reference characters identify corresponding or similar elements throughout the several views, FIG. 2 depicts a front view of an ornament decorator holder 201 in accordance with a preferred embodiment of the present application. It will be appreciated that holder 201 overcomes one or more of the above-listed problems commonly associated with conventional ornament holding devices.

In the contemplated embodiment, holder 201 includes a body 203 having two or more walls 205*a*, 205*b* forming an inner cavity 207. Cavity 207 is accessibly by an opening 208 through body 203. Body 203 further includes a base 209 configured to hold an electric motor 211 and a power supply 213. Motor 211 is connected by a wire 215 to a switch 217 disposed on the outside of a wall 205*a*. In the preferred embodiment, motor 211 is connected to an ornament attachment site 219, wherein an ornament 221 is secured within inner cavity 207 and viewable through opening 208. It is contemplated that activation of motor 211 can rotate ornament 221, as indicated with arrow 223.

Figure 3A:
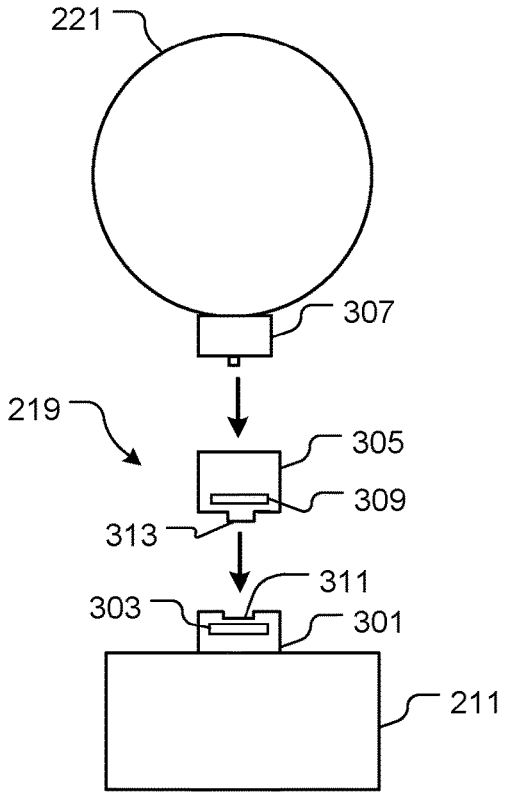
FIGS. 3A and 3B are front views of an attachment site from FIG. 2.
Figure 3B:
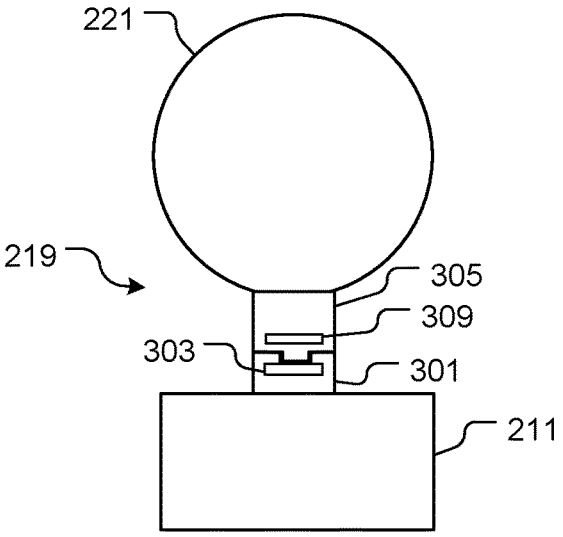

In FIGS. 3A and 3B, one contemplated embodiment of attachment site 219 is shown with detail. In the contemplated embodiment, attachment site 219 includes a projections 301 extending upward from motor 211 and having a first magnet 303 disposed within projection 301. Attachment site 219 further includes a cap 305 configured to slidingly attach to an ornament hanger 307, or directly to ornament 221. Cap 305 can have a second magnet 309, configured to secure cap 305 to projection 301. It is further contemplated that projection 301 and cap 305 can have alternating notches 311 and protrusions 313 configured to engage when attachment site 219 is in a closed position, as shown in FIG. 3B. It should be appreciated that in an alternative embodiment, only one magnet is used, either in the cap or in the projection 301, wherein the other piece includes a piece of metal configured to connect to the single magnet.

During use of device 301, ornament 221 is secured to attachment site 219. Motor 211 can then be activate to spin ornament 221 within cavity 207, thereby allowing a user to decorate ornament 221 with markers or the like and create smooth and consistent lines.

It should be appreciated that one of the unique features believed characteristic of the present application is the incorporation of a motor into an ornament holder. It should be understood that the motor allows for users to control movement of the ornament, and is therefore an improvement over the prior art.

It should be understood that during use, the ornament is attached to the attachment site, wherein activation of the motor causes the ornament to rotate, the user can then use a writing utensil, such as a marker, to decorate the rotating ornament.

Figure 4A:
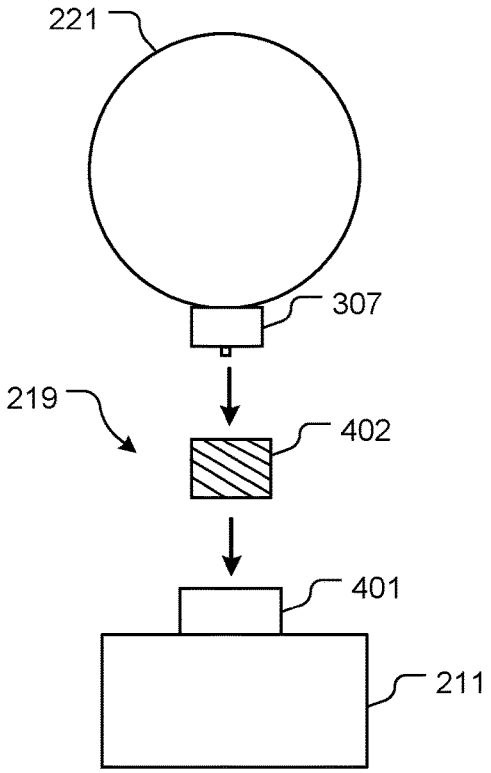
FIGS. 4A and 4B are front views of an alternative embodiment of the attachment site of FIG. 2.
Figure 4B:
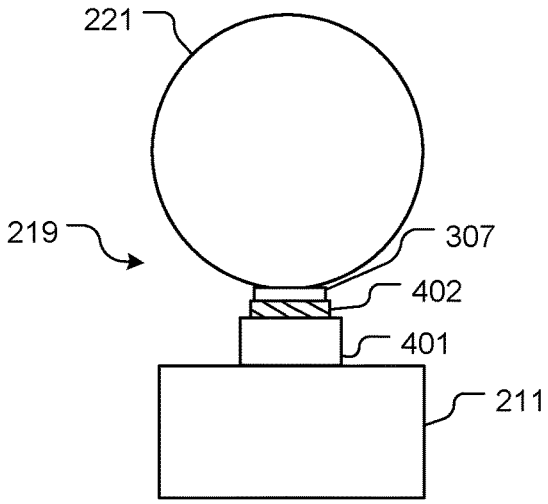

In FIGS. 4A and 4B, an alternative embodiment of attachment site 219 is shown, wherein a threaded style connection is used to engage cap 402 with projection 401.

Figure 5A:
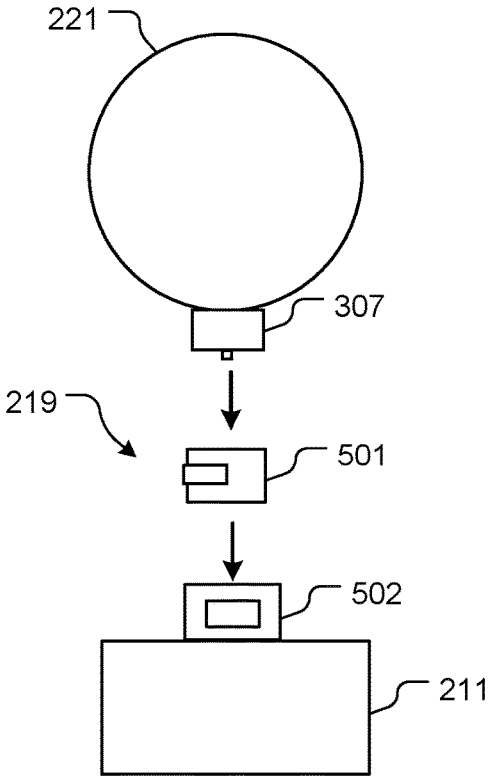
FIGS. 5A and 5B are front views of an alternative embodiment of the attachment site of FIG. 2.
Figure 5B:
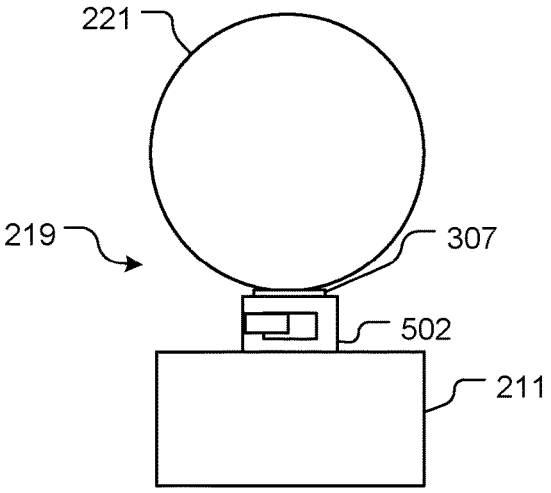

In FIGS. 5A and 5B, yet another alternative embodiment of attachment site 219 is shown, wherein cap 501 includes a locking mechanism to engage with projection 502, such as through a twisting engagement of the cap with the projection.

It should be appreciated that any means of connecting the cap and the projection is contemplated and can be used with the present invention.

Although body 203 is shown being substantially rectangular, it is contemplated that body 203 can be in additional forms such as spheres, stars, and/or trees, while maintaining the same functionality.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An ornament decorator system for decorating an ornament, the system, comprising:

the ornament having an ornament hanger;

an ornament decorator holder, having:

a body with a first wall and a second wall extending from a base and forming an opening into an inner cavity configured to receive the ornament, the ornament being at least partially surrounded by the first and second walls and accessible via the opening:

a motor disposed within the base and the motor having:

an activation switch accessible from an outside wall of the body;

a power source connected to the motor; and an ornament attachment site accessible from the inner cavity and configured to attach the ornament to the motor via the ornament hanger, the ornament attachment site, having:

a projection extending from the motor;

a first magnet secured to the projection;

a cap having a protrusion removably secured to and configured to engage with the projection;

a second magnet secured to the protrusion, the second magnet is configured to engage with the first magnet;

wherein the ornament hanger attaches to the cap;

wherein the motor rotates the ornament within the inner cavity via the ornament attachment site;

wherein the ornament is accessible from the opening of the body while the ornament is rotated via the motor.

2. The system of claim 1, wherein the ornament attachment site further comprises:

the cap is configured to slidingly attach to the ornament hanger, the cap having:

a metallic device;

wherein the first magnet and the metallic device secure the ornament to the projection.

3. The system of claim 2, wherein the ornament attachment site further comprises:

a notch removed from a top level of the projection; and wherein the notch and the protrusion engage to secure the cap and the projection together.

4. The system of claim 2, wherein the metallic device is the second magnet.

5. The system of claim 1, wherein the ornament attachment site further comprises:

the cap is configured to slidingly attach to the ornament hanger; and the projection is configured to extend upward from the motor;

wherein the cap and the projection engage via a threaded connection.

6. A method of decorating an ornament, the method comprising:

providing the system of claim 1;

securing the ornament to the ornament attachment site;

activating the motor to rotate the ornament; and decorating the ornament with one or more writing devices through the opening.

* * * * *